US005290028A

United States Patent [19]

Bartoli

[11] Patent Number: 5,290,028

[45] Date of Patent: Mar. 1, 1994

[54] IMPACT ABSORBING BASE

[76] Inventor: Ronald W. Bartoli, 660 Green Acre Dr., Fullerton, Calif. 92635

[21] Appl. No.: 865,467

[22] Filed: Apr. 9, 1992

[51] Int. Cl.[5] ..... A63B 71/00

[52] U.S. Cl. ..... 273/25

[58] Field of Search ..... 273/25

[56] References Cited

U.S. PATENT DOCUMENTS 1,244,044 10/1917 Falconer .
2,046,126 6/1936 Latina .
2,103,148 12/1937 Conrad .
2,275,547 3/1942 Mouch .
2,405,492 8/1946 Corbett .
2,759,999 7/1956 Orsatti .
3,466,039 9/1969 Golomb .
3,703,285 11/1972 Perry .
3,971,558 7/1976 Gardetto ..... 273/25
4,266,768 5/1981 Hall ..... 273/25
4,398,715 8/1983 Hall .
4,405,130 9/1983 Mullany .
4,448,414 5/1984 Gutierrez .
4,529,199 7/1985 Fatool .
4,542,901 9/1985 Fatool et al. .
4,723,779 2/1988 Hauser .
4,744,561 5/1988 Hall .
4,830,368 5/1989 Green ..... 273/25
4,976,430 12/1990 Brandon ..... 273/25
5,000,447 3/1991 Bartoli ..... 273/25

*Primary Examiner*—Theatrice Brown
*Attorney, Agent, or Firm*—Foley & Lardner

[57] ABSTRACT

A low profile impact absorbing base in which the base comprises downwardly and outwardly tapering top and peripheral walls which collectively define a hollow interior except for resilient deformable ribs, and a central hub integrally formed with the top wall of the base. A separate post is mounted on a carrier sleeve, with the post being constructed to fit into an embedded retaining sleeve or capable of being inserted directly into the ground. The outside surface of the carrier sleeve and the inside surface of the central hub are complementarily configured so that the post and sleeve can be inserted upwardly into the central opening in the hub and frictionally retained therein. The thickness and spacing of the ribs are such that the ribs can be laterally inwardly deformed as a result of sliding impact forces so that such forces can be absorbed without injury to the player. The base is relatively low in height thereby providing an additional safety factor in that players normally tend to slide over the base as opposed to sliding directly into a side wall of the base causing the noted lateral inward deformation.

7 Claims, 2 Drawing Sheets

IMPACT ABSORBING BASE

BACKGROUND OF THE INVENTION

The present invention relates as indicated to an impact absorbing base, and relates more particularly to a base which can be used for playing baseball or softball and which greatly minimizes injuries to players contacting, particularly sliding into, the base.

Bases must possess certain characteristics, one of which is that the base must not be shiftable when touched, stepped upon or slid into. That is, the base must not be allowed to laterally shift. Bags are frequently retained in place by long spikes which are separate members and adapted to receive a strap attached to the bottom of the bag for securing the base to the spike which is driven into the ground. A second form of base and one which is used at the major and minor league levels comprises a base formed with a downwardly extending post on the undersurface of the base, with the post extending into a complementary shaped retaining sleeve embedded in the soil. The connection is typically non-rotating, with the post and retaining sleeve assembly thus precluding the base from either rotating or shifting laterally.

Break away bases are also known. This type of base breaks away from its mounting when impact forces above a certain level are encountered. One of these break away bases is shown in U.S. Pat. No. 4,398,715, issued to Hall. The patented arrangement comprises a base top which is detachably secured to a ground plate or equivalent holding device. The momentum of a sliding player shears or breaks away the detachable upper portion of the base from the fixed ground plate. This type of base has the disadvantage that the base must be retained in place on the fixed ground plate unless and until certain energy levels are reached, thereby requiring rather elaborate interconnecting means between the base and the fixed ground plate. There are numerous anchoring points, all of which must be secured in order to re-attach the base to the plate after the base has been broken away. Moreover, when impact forces cause the base to break away from its associated mounting, the base frequently is separated from the sliding player, thereby making rulings of safe and out relatively difficult. Further, if the base is detached from its mounting when not in use, for example, to prevent theft, the anchoring portion of the assembly is exposed to damage from weather or vandalism when the playing field is not in use.

A further solution is proposed in U.S. Pat. No. 5,000,447, issued to the present inventor. While the base disclosed in the '447 patent has performed very well and has been commercially successful, its size and mounting do present certain difficulties. The base was primarily designed for use on playing fields particularly adapted for relatively advanced players. The base is therefore comparable to bases then and still being used at the high school, college, minor and major league levels. In addition, the base was mounted by means of a specially configured post adapted to extend into an embedded retaining sleeve for anchoring the base in such sleeve. This requires relatively permanent base installations thereby increasing both the purchasing and installation costs for a set of bases of the type disclosed in the patent. This has proven to be a particular problem for operators of fields for very young players, where budget limitations normally do not justify the purchase of the more advanced base assemblies disclosed in the '447 patent, despite the concern of virtually everyone for the safety of young players.

From the above discussion it will be understood that there are number of design parameters that must be considered in the design of an impact absorbing base. The base must be rigid enough to be stepped on without deforming, and at the same time resilient enough to deform and absorb the impact of a player sliding into it. The impact absorption characteristic of the base must be such that it adequately absorbs impact forces of younger, lighter weight players, as well as older, heavier players, from the substantial impact forces resulting from sliding into the base. Moreover, the base and anchoring arrangement must be such that it meets the above criteria while at the same time being affordable to the widest possible range of field environments, from the very youngest players to the most experienced professional players.

SUMMARY OF THE INVENTION

The present invention is specially designed to meet the desirable criteria noted above. It possesses excellent impact absorption capabilities, and is designed with greater flexibility in terms of its mounting. A removably attached post is interconnected to the base at a bottom opening in the base, and the post is designed so that it can be non-rotatably received in an embedded sleeve of the type referred to above and disclosed in the '447 patent, or the post can be simply embedded in the ground through application of force applied to the top of the base. The base is thus adaptable to the relatively more expensive and sophisticated base anchoring systems of advanced players as well as to the typical fields of younger players in which no anchoring devices are utilized and the base is simply secured in the ground during play and removed therefrom following play.

A further important feature of the invention is the low profile of the base. The base is comprised of downwardly and outwardly tapering top and peripheral walls which collectively define a base of greatly reduced overall height thereby enhancing the possibility of a player sliding up and over the base rather than directly into the base where possible injury can result, even with the impact absorption features of the present invention. In the event of direct and continual engagement, the impact absorbing characteristics of the base come into play, but there are still forces that tend to raise the base from its mounting. These forces are likewise undesirable and can lead to injury. Thus, the ability to "slide over" the base is an important feature of the invention.

A further feature of the invention is the versatility and adaptability of the post detachably secured to the base. The preferably molded base includes a central hub which defines an inner surface and central opening. The post is secured, preferably by molding, to a surrounding sleeve, with the exterior surface of the sleeve and the inner surface of the hub being configured such that the sleeve can be inserted upwardly and removably attached to the hub. The sleeve is formed of resilient elastomeric material, and the interconnection between the sleeve and the hub is preferably provided by a frictional fit comprised of projections or tongues formed in the periphery of the sleeve and mating grooves formed in the inner surface of the hub. The tongues and grooves are oriented such that when the post is in its mounted position, the hub of the base will become detached from the sleeve only after a certain force level has been reached. This precludes inadvertent and undesirable detachment of the base from its anchor, while at the same time permitting the base to be detached from the sleeve and post where forces exceed a predetermined level. Such forces would normally be in excess of those forces that can be absorbed by the base.

The absorption of the impact energy is accomplished by the present invention in essentially the same manner as described in my earlier patent. A series of spaced ribs are interconnected between the central hub portion of the base and the peripheral wall, and extend vertically between the top wall and the bottom surface of the base. The ribs are spaced and oriented in such a fashion that a player engaging one side of the base, for example, while sliding, will cause such side face to be forced radially inwardly toward the center of the base. The base and ribs are formed of rubber or other resiliently deformable material so that the impact forces can be absorbed upon impact, and released when impact is over so that the base regains its shape. The ability to absorb impact forces can be controlled to a large degree based on the spacing and thickness of the ribs. The spacing and rib dimension will also control the ability of the base to withstand a player stepping on the base without undue flexure. The orientation and spacing of the ribs permits necessary vertical support while at the same time permitting the absorption of lateral forces. If desired, additional impact absorption can be obtained by inserting in the spaces between the ribs a suitable shock absorbing material such as open celled, expanded polymers.

These and other objects and advantages of the invention will become apparent as the following description proceeds in particular reference to the application drawings.

DETAILED DESCRIPTION OF THE PREFERRED EMBODIMENTS

Figure 1:
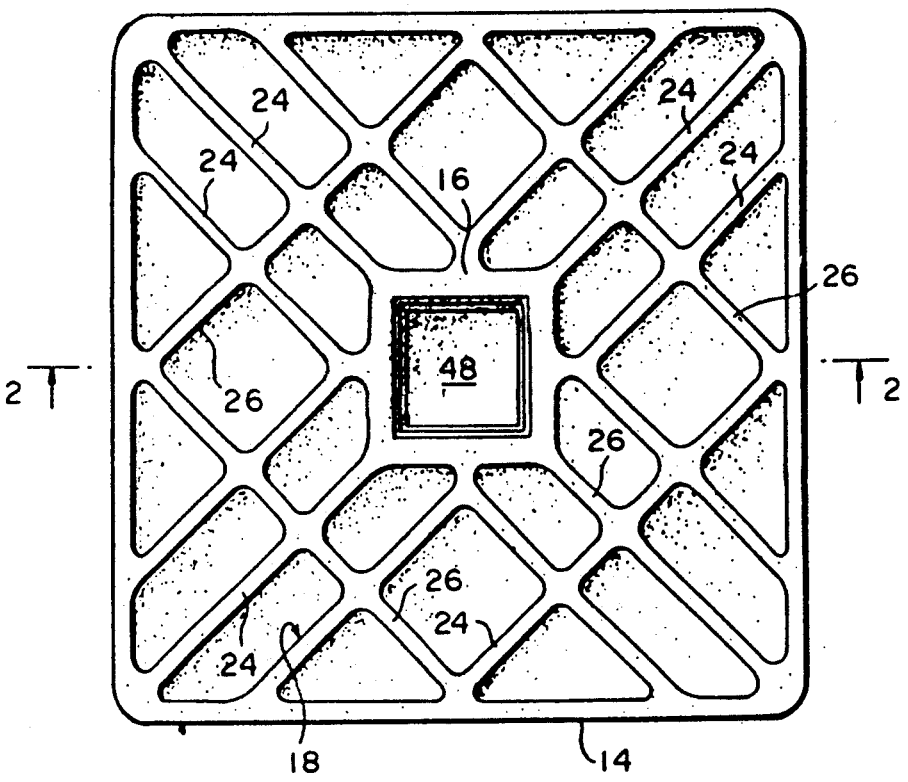
FIG. 1 comprises a bottom plan view of the underside of a base constructed in accordance with the present invention.
Figure 2:
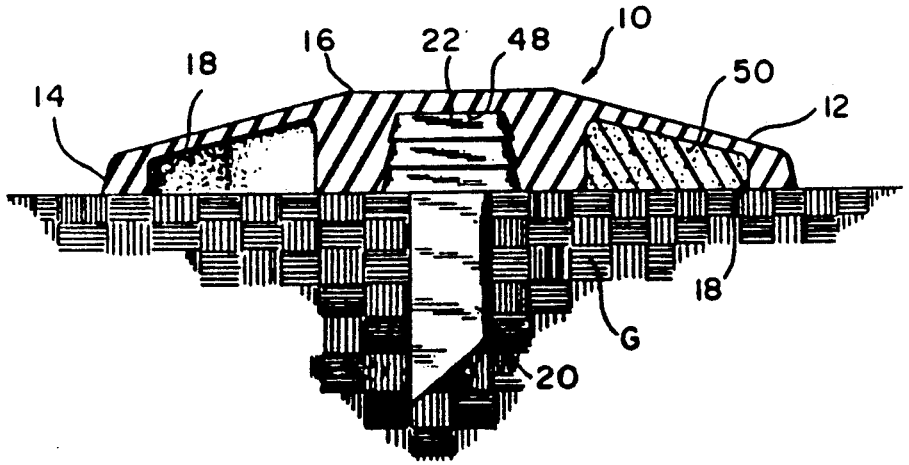
FIG. 2 is a cross-sectional view taken on line 2—2 of FIG. 1 but showing the base in inverted form, and combined with a post shown embedded in the ground.

Referring to FIGS. 1 and 2, the base constructed in accordance with the present invention is generally indicated at 10 and comprises a top wall 12 and a continuous peripheral side wall 14. The top and peripheral walls define a hollow interior except for a central hub 16 and an array of deformable ribs commonly designated 2 at 18. The ribs will be described in more detail when reference is specifically made to FIG. 1.

The base assembly comprises a separately formed post generally indicted at 20 and a post sleeve or carrier 22 to which the post is rigidly secured, for example, during molding of the sleeve. The details of the post 20 and sleeve 22, and the manner in which these members are detachably connected to the hub 16 of the base will be described in more detail when particular reference is made to FIGS. 3-5. In the FIG. 2 use form, the post is shown embedded in the ground G. The bottom surfaces of the ribs 18 and hub 16 are coterminous to form the bottom plane of the base, which plane engages the surface of the ground when the base is properly installed as shown in FIG. 2. Alternatively, the post is constructed to be received in a buried retaining sleeve in the event that type of mounting arrangement is provided for, as disclosed in my earlier patent.

Referring to FIG. 1, the spacing and configuration of the ribs 18 can be clearly seen. The ribs comprise one series of parallel ribs 24 which extend in one direction, and another series of spaced ribs commonly designated at 26 which extend parallel to each other and in a direction perpendicular to the first set of ribs 24. In addition to being interconnected to each other, the outer ends of both the ribs 24 and 26 are integrally formed with the peripheral wall 14, and the inner ends of the ribs 24 and 26 are preferably integrally formed with the central hub 16. The ribs interconnect with the hub at all four corners, and along each side intermediate the length of each side. The ribs are thus divided effectively into four basic quadrants, in the general form of triangles with a truncated top surface, with the triangle being bounded by the outer periphery of the base and being bounded at either side by the ribs 24 and 26 extending from the corner of the base to the corner of the central hub 16.

It will thus be seen that when impact forces engage the peripheral wall of the base along one side thereof, for example, along the side at the bottom of FIG. 1, such side can be forced inwardly toward the center of the base. The kinetic energy of the slide is thus dissipated or dampened by the rib arrangement. The absorbed energy and the resilience of the ribs permit the ribs to return to their original position following impact. Such resilient return movement is gradual and essentially constant, and normally unnoticed by the player.

The base 10 and the preferably integrally formed hub 16 and ribs 24 and 26 are formed of rubber or other resiliently deformable material of a hardness in the range of 50 to 70, as measured by a Shore durometer. The particular hardness can be selected to correspond in general to the age and consequently the weight of the players, with a softer base being used by lighter weight players, and a less resilient material being used for adult players. In either event, the base deforms laterally inwardly upon contact, in order to avoid any sudden force or impact while sliding.

An important feature of the present invention is in the low profile of the base. As noted above, this low profile, together with the tapered top and peripheral walls, permit the player to normally slide over the base as opposed to directly engaging a side wall of the base. Although the base is specifically designed to receive and absorb the lateral impact forces if such direct contact is made, it is preferred to have players simply slide over the base and avoid impact altogether. In addition to enhancing safety, the lower profile base, and particularly the manner in which it is anchored in the ground, permits the base to be used on less developed and sophisticated playing fields, thereby greatly expanding the use of the base to all ages of players.

In a preferred embodiment, the thickness of the top and peripheral walls 12 and 14 is 3/16". The overall height of the base at its tallest point in the central region thereof is 1½", with the top wall tapering downwardly and outwardly to the peripheral wall whose height is approximately ¾". The base is 14½ along each side, similar to the dimensions of bases of much greater thickness.

Figure 3:
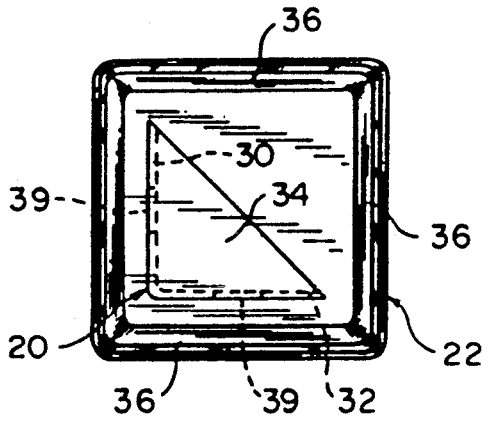
FIG. 3 is a top plan view of the post and the sleeve mounting the post.
Figure 4:
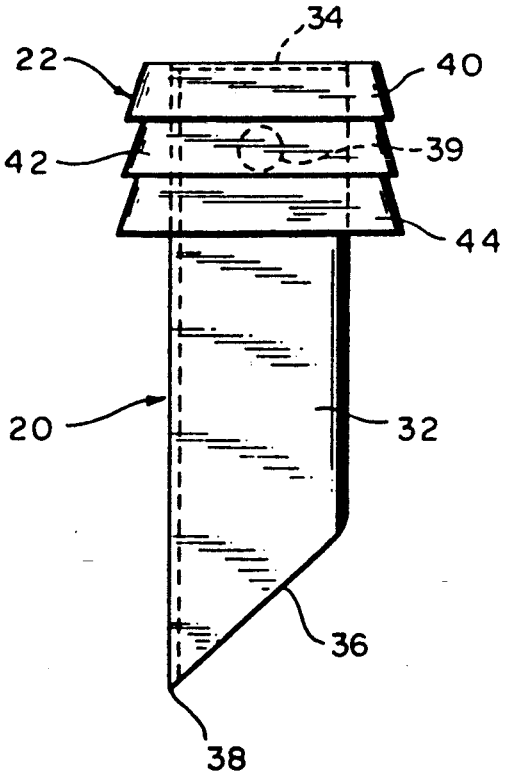
FIG. 4 is a side elevational view of the post and sleeve.
Figure 5:
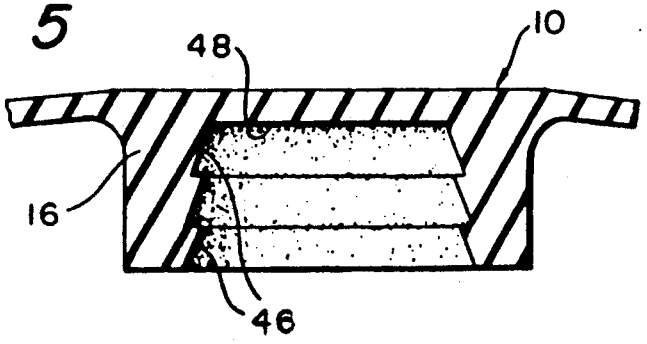
FIG. 5 is a partially fragmentary view showing in more detail the central hub of the base.

An important feature of the invention is its versatility of mounting. Referring to FIGS. 3–5, the post 20 is comprised of two legs 30 and 32 arranged perpendicularly to each other. The legs can be integrally formed and bent or separately formed and rigidly interconnected by welding, for example. A top plate 34, triangular in configuration, extends over the top surfaces of the walls 30 and 32 and serves to interconnect the same at the top thereof. The bottom surface of each side wall 30 and 32 is beveled as shown at 36 to form a point 38 where the side walls intersect at their lowermost points. The post is preferably metallic, and more preferably made of cadmium plate steel.

The elastomeric sleeve 22 surrounds the post 20 and is preferably molded to the post. The sleeve 22 is generally rectangular in cross-sectional configuration, being comprised of opposed side walls commonly designated at 36. In order to secure to the sleeve 22, each leg 30 and 32 is formed with a circular aperture or opening commonly designated at 39. These openings are filled during the molding process, with the molded rubber extending through the openings serving to interlock the legs to the sleeve.

The exterior surface of the sleeve is molded to provide three distinct parallel beveled sections 40, 42 and 44, respectively, which are successively of slightly greater diameter (in a downwardly direction) at the largest dimensions thereof along their bottom surfaces.

The sleeve 22 is of rubber or other resiliently deformable material having a hardness in the same range as discussed above with regard to the base and ribs. The particular hardness can be selected to provide a relatively rigid, yet detachable, connection between the post and sleeve and the central hub of the base.

In a preferred embodiment, the height of each section 40,42, and 44 is approximately 0.40", and the sleeve is approximately 2½" square at its widest point.

Referring to FIG. 5, which comprises a fragmentary sectional view through the central hub 16 of the base, the hub defines a central opening generally rectangular in cross-section configuration (see FIG. 1). The surface of each interior side wall of the hub is beveled or undercut as commonly designated at 46, with the hub also including a top wall 48 which defines the bottom of the central opening. The beveled surfaces 46 form grooves which are spaced, configured and dimensioned to tightly frictionally retain the sleeve 22 secured to the post 20, when the post-sleeve assembly is inserted upwardly into the central opening. FIG. 2 shows the post and sleeve assembled in the hub, with the top of the post and sleeve contacting the underside of the top wall 48 of the central hub to form a relatively tight assembly.

The hardness of the materials of the sleeve 22 and base 10 is such that when the sleeve and post are inserted upwardly into the notched opening in the hub formerly bevels 46, the respective beveled surfaces will resiliently deform until the sleeve reaches the position shown in FIG. 2. In such position, the sections 40, 42 and 44 will tightly frictionally engage the beveled surfaces 46. Each bevelled surface 46 is defined at its bottom by a flat shoulder which is engaged by the bottom surface of the corresponding section, thereby retaining the post and sleeve in place. The retention force is such that substantial positive force is required to separate the sleeve and post from the hub. Since the basic concept of the impact base is that the base, at some predetermined level of force, can be disengaged from its mount, the frictional retaining forces between the sleeve and the hub are selected so that such disengagement can occur if necessary, for example, when a side of the base has encountered excessive force as the result of a player sliding into the base. In other words, when a player contacts a side wall of the base with excessive force, that side will resiliently deform, and if such deformation is not sufficient to absorb the impact forces, the latter will then act on the interconnection between the sleeve and the central hub. If sufficiently great, such forces cause disengagement of the base from the post and sleeve, thereby providing a further safety factor.

As illustrated and described, the legs 30 and 32 of the post form a generally L-shaped leg assembly, and the top wall 34 is within the confines between the legs. The post is thus configured to be utilized in a buried retaining sleeve assembly of the type commonly used, and illustrated in my earlier U.S. Pat. No. 5,000,447. The buried retaining sleeve is typically rectangular in cross-section, and the dimensions of the legs 30 and 32 are selected so that when the post is positioned in such a buried retaining sleeve, the legs will engage with relatively close clearance adjoining side walls of the sleeve whereby rotation of the post is precluded. Typically, each leg 30 and 32 is 1.5" in width and 7" long from top wall 34 to point 38.

Where the playing field is not provided with buried retaining sleeves of the type illustrated in my earlier patent, the post can be embedded in the ground in the manner shown in FIG. 2. To embed the post, the post is engaged with the ground and the top surface of wall 48 stepped on and forced downwardly. The embedment of the post continues until the bottom surfaces of the ribs and central hub engage the ground. When so mounted, the low profile of the base frequently results in players sliding up and over the base as described above. If rigid contact is made, the ribs are resiliently deformed, and where the force is excessive, the hub 16 and consequently the base can be disengaged from the embedded post and sleeve. If re-engaged, the frictional forces retaining the connection between the hub of the base and the sleeve of the post assembly is such that following play, the base can be quickly and easily removed with the connection between the hub and sleeve remaining intact.

If it is desired to vary the ability of the base to absorb impact forces, a suitable shock absorbing material, shown at 50 in FIG. 2, can be provided in some or all of the spaces between adjoining ribs 24 and 26. The absorbing material has been shown by way of example between adjoining ribs 24 and 26 on one side of the base, and it will be understood that the same material could be provided on the opposite side of the base, and elsewhere as desired. Various open celled, expanded polymers have proven satisfactory for this purpose, including the commercially available sponge product "Ensulite". One disadvantage of that product is that on wet fields water may enter the open cells of the material and consequently reduce the ability of the material to absorb sliding impact. In such an event, close cell sponges could be substituted.

In addition to the lower profile, it is preferable that the interior ribs 24 and 26 are relatively thin. Rib thicknesses of ⅛" have proven very satisfactory, as compared to the ribs in my earlier patent which are approximately ½" in thickness.

The features and advantages of the invention should be apparent from the foregoing description. While particular embodiments of the invention have been shown and described, it will be obvious to one skilled in the art that certain modifications can be effected without departing from the spirit of the invention. For example, the post 20 and sleeve 22 could be integrally molded with the central hub 16 of the base. Although severability of the base from the post and sleeve would then be sacrificed, manufacturing of the assembly would be simplified and less expensive. Moreover, such a modified base would retain the important advantages of the invention of low profile and flexibility of mounting the assembly either directly in the ground or in an embedded sleeve.

What is claimed is:

1. A low profile impact absorbing base, comprising:

(a) downwardly and outwardly tapering resiliently deformable top and peripheral walls defining an above ground portion of the base and also defining a hollow interior above the ground;

(b) resiliently deformable ribs arranged within the hollow interior, said ribs being spaced from each other and having a vertical dimension such that the bottoms of said ribs and said peripheral wall define the bottom of the base which engages the ground;

(c) a central hub integrally formed within said top and the adjacently disposed ribs and having an inner surface defining a central opening, the bottom of said central hub being coterminous with the bottoms of said ribs so as to provide a central support area for the base, (d) a central post separate from said base, and a mounting sleeve around and connected to said post, (e) interengagable means formed on said inner surface of said hub and on an outer surface of said mounting sleeve for detachable interengagement when said mounting sleeve is extended into said central opening of said hub, said interengagable means being of deformable rubber whereby said mounting sleeve is frictionally retained in said hub but can be disengaged therefrom when a lateral force of predetermined magnitude is applied to said base, (f) said central post consisting of first and second legs connected at adjoining edges to form a substantially L-shaped transverse configuration, and a top wall attached to said legs at the top thereof and extending therebetween, said legs tapering downwardly at the bottoms thereof to provide a generally pointed leading surface for ground penetration, with the transverse configuration of said legs also adapting the post for mounting in an embedded retaining sleeve, and wherein said ribs are first laterally inwardly deformed as a result of sliding impact forces, and thereafter said mounting sleeve is disengaged from said hub and base when said sliding impact forces reach said predetermined magnitude.

2. The impact absorbing base of claim 1, in which the ribs are arranged in a series of rows which are perpendicular to each other and extend at an angle to any portion of the peripheral wall, and wherein certain of the ribs are attached to said central hub.

3. The impact absorbing base of claim 1, in which the ribs and top and peripheral walls are integrally formed of molded rubber having a hardness of between 50 and 70, as measured by a Shore durometer.

4. The impact absorbing base of claim 1, further including an additional impact absorbing means in the form of an expanded polymer inserted in the spaces between at least certain of said ribs.

5. The impact absorbing base of claim 1, wherein the outer periphery of said mounting sleeve contains a plurality of bevelled sections which are adapted to frictionally engage correspondingly dimensioned grooves formed in the inner surface of said central hub, whereby said post and sleeve can be inserted upwardly into said hub and fractionally retained thereby.

6. The impact absorbing base of claim 1, wherein the overall height of said base at its maximum dimension near a center of said base is 1.5 inches, with said peripheral walls having the height of approximately 0.75 inches, thereby providing a base of low profile which facilities a player sliding up and over the base.

7. A low profile impact absorbing base, comprising:

(a) downwardly and outwardly tapering resiliently deformable top and peripheral walls defining an above ground portion of the base and also defining a hollow interior above the ground;

(b) resiliently deformable ribs arranged within the hollow interior, said ribs being spaced from each other and having a vertical dimension such that the bottoms of said ribs and said peripheral wall define the bottom of the base which engages the ground;

(c) a central hub integrally formed within said top and the adjacently disposed ribs and having an inner surface defining a central opening, the bottom of said central hub being coterminous with the bottoms of said ribs so as to provide a central support area for the base, (d) a central post separate from said base and formed of a pair of interconnected legs, and a mounting sleeve around and connected to said post, said post being connected to said sleeve by means of apertures formed in each of said legs of said post, said sleeve being molded around said legs and said molded material flowing into said apertures thereby serving to interlock said post to said sleeve, (e) interengagable means formed on said inner surface of said hub and on an outer surface of said mounting sleeve for detachable interengagement when said mounting sleeve is extended into said central opening of said hub, said interengagable means being of deformable rubber whereby said mounting sleeve is frictionally retained in said hub but can be disengaged therefrom when a lateral force of predetermined magnitude is applied to said base, (f) said central post being configured such that it can be inserted into an embedded retaining sleeve in the earth or embedded directly in the earth where no retaining sleeve is present, and wherein said ribs are first laterally inwardly deformed as a result of sliding impact forces, and thereafter said mounting sleeve is disengaged from said hub and base when said sliding impact forces reach said predetermined magnitude.

* * * * *